US005514003A

United States Patent [19]

Lewis

[11] Patent Number: 5,514,003

[45] Date of Patent: May 7, 1996

[54] QUICK RELEASE MECHANICAL ATTACHMENT WITH INTEGRAL ELECTRICAL INTERCONNECT

[75] Inventor: Richard S. Lewis, Chino Hills, Calif.

[73] Assignee: Loral Aerospace Corp., New York, N.Y.

[21] Appl. No.: 291,119

[22] Filed: Aug. 16, 1994

[51] Int. Cl.[6] ..... H01R 13/625

[52] U.S. Cl. ..... 439/332; 439/34; 439/669; 414/540

[58] Field of Search ..... 439/34, 668, 669, 439/332, 577, 13, 18, 20, 21, 23, 24, 25; 414/540, 543; 212/253; 384/277, 490, 492

[56] References Cited

U.S. PATENT DOCUMENTS

| | | | |
|---|---|---|---|
| 1,926,264 | 9/1933 | Conners | 439/13 |
| 3,109,541 | 11/1963 | Matson | 212/253 |
| 4,392,698 | 7/1983 | Mellott | 439/34 |

*Primary Examiner*—Gary F. Paumen
*Assistant Examiner*—Hien D. Vu
*Attorney, Agent, or Firm*—K. W. Float; A. W. Karambelas

[57] ABSTRACT

A quick release mechanical attachment that forms part of a missile loading system for loading a missile onto a launch rail disposed on a vehicle. An electric crane mechanism, comprising a boom and hoist, is used to lift the missile adjacent the launch rail, and the quick release mechanical attachment is used to interface the electric crane to the deck of the vehicle. The quick release mechanical attachment comprises a base that includes a body having an internal bore and a counterbore. An electrical contact arrangement comprising a plurality of insulated conductive members is disposed in the counterbore. A plurality of electrical connectors are coupled to the conductive members, and first securing members are provided for securing the electrical contact arrangement in the counterbore. The base in its assembled condition has a predetermined internal taper. The electrical contact arrangement comprises a plurality of nonconductive spacers that surround the conductive members. The rotatable coupler comprises a body and an inner mast tube secured to the body. An electrical contact arrangement comprising a plurality of insulated conductive members is secured to the body and the inner mast tube. The electrical contact arrangement comprises a plurality of nonconductive spacers that surround the conductive members. A plurality of electrical connectors are coupled to the conductive members, and second securing members are coupled to the inner mast tube for securing the electrical contact arrangement to the body. The assembled coupler has a predetermined external taper that substantially matches the taper of the base.

17 Claims, 2 Drawing Sheets

QUICK RELEASE MECHANICAL ATTACHMENT WITH INTEGRAL ELECTRICAL INTERCONNECT

BACKGROUND

The present invention generally relates to apparatus for loading a missile onto a missile launcher, and more particularly, to a quick release mechanical attachment having an integral electrical interconnect that is used to interface an electric crane mechanism to a vehicle, which electric crane mechanism is used to load the missile onto the missile launcher.

Heretofore, missiles, such as the Chaparral missile manufactured by the assignee of the present invention, are stored in a compartment of a vehicle, for example, and must be removed and loaded onto a launch rail disposed on the vehicle. In the past, it normally takes four people to physically load the missile onto the launch rail. The manner in which this was done in the past is as follows.

The turret of the vehicle is turned so that it is oriented longitudinal to the vehicle. The missile is removed from its storage compartment and four men then carry the missile up the rear tailgate of the vehicle and lift the missile until slots on the missile engage a track on the launch rail. The missile is then slid the entire length of the launch rail until a firing mechanism engages a locking mechanism at the far end of the missile. Thereafter, canards and wings are attached to the missile after it is locked to the missile launcher.

This procedure is very dangerous in that the missile weighs about 200 pounds and can be damaged if it is dropped, which generally makes the missile inoperative. Also, it is quite difficult to orient and slide the missile onto the track. In many instances, operators have been hurt in attempting to load missiles in the manner just described.

Therefore, it is an objective of the present invention to provide for a quick release mechanical attachment having an integral electrical interconnect that is used to interface an electric crane mechanism to the vehicle, and wherein the electric crane mechanism is used to load a missile onto the missile launcher.

SUMMARY OF THE INVENTION

In order to meet the above and other objectives, the present invention forms part of a missile loading system that is used to load a missile onto a launch rail that is located on the vehicle. The missile loading system includes an electric crane mechanism, comprising a boom and hoist, that is used to lift the missile to a location adjacent the launch rail, and whereafter, one or more operators secure the missile to the launch rail. The improvement provided by the present invention comprises a quick release mechanical attachment having an integral electrical interconnect that is used to interface the electric crane mechanism to the deck of the vehicle.

More specifically, the quick release mechanical attachment comprises missile loading apparatus for loading a missile onto a missile launcher disposed on a vehicle. The apparatus comprises a boom, an electric hoist disposed on the boom for carrying the missile, and a quick release mechanical attachment coupled between the boom and the vehicle. The quick release mechanical attachment comprises a base and a rotatable coupler that mates to the base.

The base comprises a body having an internal bore and a counterbore. An electrical contact arrangement comprising a plurality of insulated conductive members is disposed in the counterbore. A plurality of electrical connectors are coupled to the conductive members, and securing members are provided for securing the electrical contact arrangement in the counterbore. The base in its assembled condition has a predetermined internal taper. The electrical contact arrangement comprises a plurality of nonconductive spacers that surround the conductive members.

The coupler comprises a body and an inner mast tube secured to the body. An electrical contact arrangement comprising a plurality of insulated conductive members is secured to the body and the inner mast tube. A plurality of electrical connectors are coupled to the conductive members, and securing members are coupled to the inner mast tube for securing the electrical contact arrangement to the body. The assembled coupler has a predetermined external taper that substantially matches the taper of the base. The electrical contact arrangement comprises a plurality of nonconductive spacers that surround the conductive members.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DETAILED DESCRIPTION

Figure 1:
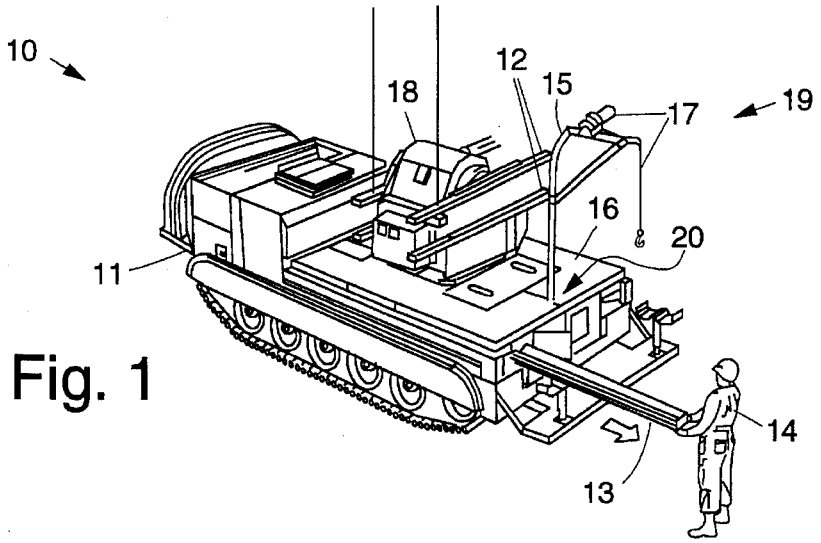
FIG. 1 illustrates a missile loading system for loading a missile onto a vehicle using a quick release mechanical attachment in accordance with the principles of the present invention.

Referring to the drawing figures, FIG. 1 illustrates a missile loading system 10 for loading a missile 13 onto a launch rail 12 of a missile launcher 18 that is disposed on a vehicle 11. The missile loading system 10 comprises a quick release mechanical attachment 20 in accordance with the principles of the present invention. The quick release mechanical attachment 20 forms part of an electric crane mechanism 19 that includes a boom 15 and hoist 17 that are secured to a deck 16 of the vehicle 11 by means of the quick release mechanical attachment 20.

The boom 15 and hoist 17 are used to support and lift the missile 13 while it is moved from a storage compartment onto the launch rail 12. This operation may be performed by one or more operators 14, but no more than two operators 14 are required to load the missile 13 with the assistance of the present invention. The operation of loading of the missile 13 onto the launch rail 12 will be discussed in more detail below, once a better understanding of the details of the present invention are understood.

Figure 2:
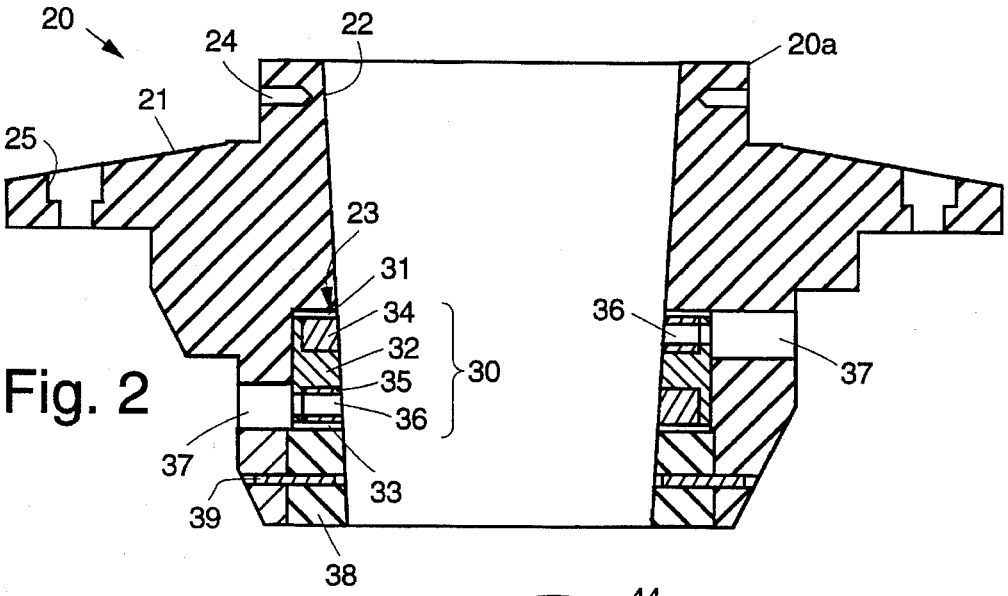
FIG. 2 illustrates a cross sectional view of a base portion of the a quick release mechanical attachment in accordance with the principles of the present invention.

Referring to FIG. 2, it illustrates a cross sectional view of a base **20*a* of the quick release mechanical attachment 20. The base 20*a* has a generally circular body 21 that may be made of a metal such as aluminum, for example, and the body 21 has an internal bore 22 that is dimensioned to accept the boom 15. The body 21 is also machined (counterbored) to provide a counterbore 23 for accepting a plurality of electrical components 30 adjacent the internal bore 22. A plurality of threaded holes 24 are provided to secure the boom 15 to the base 20***a*. A plurality of through holes 25 are provided to secure the base 20*a* to the deck 16 of the vehicle 11.

Regarding the electrical components 30, a first nonconductive spacer 31, that may be comprised of teflon material, for example, is distally disposed in the counterbore 23. A second nonconductive spacer 32 that may also be comprised of teflon material, for example, is disposed in the counterbore 23 adjacent the first nonconductive spacer 31. The second nonconductive spacer 32 has a T-shaped cross section. A third nonconductive spacer 33, which is substantially the same as the first nonconductive spacer 31, and which may be comprised of teflon material, for example, is disposed in the counterbore 23 adjacent the second nonconductive spacer 31. Thus, a first nonconductive spacer arrangement is formed wherein two openings are formed surrounded by nonconductive spacer material.

Two conductive members 34, 35, which may be made of copper, for example, are disposed in the two openings between respective ones of the nonconductive spacers 31, 32, 33. A threaded screw hole 36 is provided in each of the conductive members 34, 35 and two radial holes 37 are provided in the body 21 to permit engagement of electrical connectors 71, 72 (shown in FIG. 4) that couple electricity by way of the quick release mechanical attachment 20 to the hoist 17. A first securing ring 38 is threaded into the end of the base 20*a* to secure the electrical components in the counterbore 22. A first plurality of pins 39 are provided to lock the first securing ring 38 in place.

In order to form the finished base 20*a*, the assembled base 20*a* is machined at the inner bore 22 so that it has approximately a three degree taper, tapering toward the electrical components 30. This taper is machined after assembly of the base 20*a* because of the difficulty in machining many individual pieces and attaining accuracy in the finished assembly.

Figure 3:
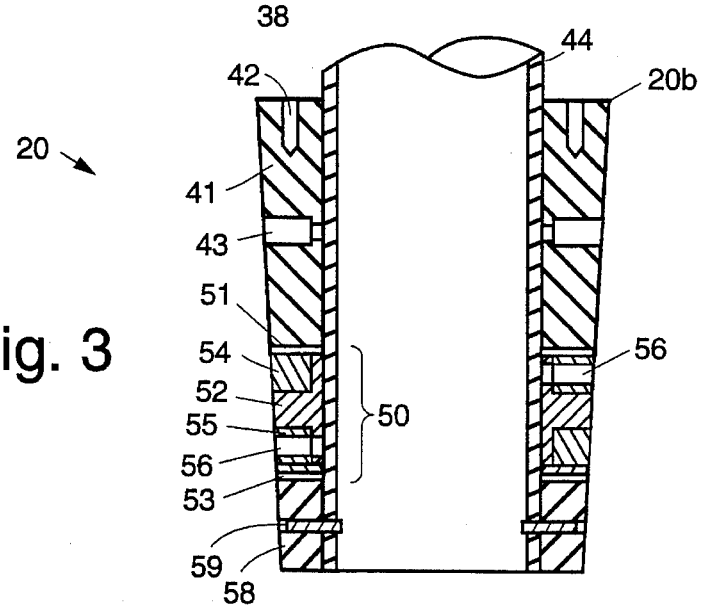
FIG. 3 illustrates a cross sectional view of a bottom portion of a boom that interfaces to the base portion of the quick release mechanical attachment shown in FIG. 2.

FIG. 3 illustrates a cross sectional view of a coupler 20*b* for the boom 15 that interfaces to the base 20*a* of the quick release mechanical attachment 20. The coupler 20*b* is configured to have a set of electrical components 50 that mate with the electrical components 30 of the base 20*a*. The coupler 20*b* is comprised of a circular or cylindrical body 41 which may be made of aluminum, for example. The body 41 has a plurality of screw holes 42 in its upper end that permit securing of a breach lock plate 63 (shown in FIG. 4) that interlocks using shoulder bolts 24*a* (FIG. 4) that insert into the holes 24. The body 41 also has a plurality of radial screw holes 43 in its wall that are used to secure an inner mast tube 44 to it. The inner mast tube 44 may be comprised of steel, for example Regarding the electrical components 50, a fourth nonconductive spacer 51, that may be comprised of teflon material, for example, abuts an end of the body 41 distal from the screw holes 42. A fifth nonconductive spacer 52 that may also be comprised of teflon material, for example, is disposed adjacent the fourth nonconductive spacer 51. The fifth nonconductive spacer 52 has a T-shaped cross section. A sixth nonconductive spacer 53, which is substantially the same as the fourth nonconductive spacer 51, and which may be comprised of teflon material, for example, is disposed adjacent the fifth nonconductive spacer 5 I. Thus, a second nonconductive spacer arrangement is formed wherein two openings are formed surrounded by nonconductive spacer material.

Two conductive members 54, 55, which may be made of copper, for example, are disposed in the two openings between respective ones of the nonconductive spacers 51, 52, 53. A threaded screw hole 56 is provided in each of the conductive members 34, 35 to permit engagement of electrical connectors 61, 62 (shown in FIG. 4) that couple electricity by way of the quick release mechanical attachment 20 to the hoist 17. A second securing ring 58 is threaded onto an end of the inner mast tube 44 to secure the electrical components to thereto. A second plurality of pins 59 are provided to lock the first securing ring 38 in place.

In order to form the finished coupler 20*b*, the assembled coupler 20*b* is machined along its outer surface so that it has approximately a three degree taper, tapering toward the electrical components 30, which substantially matches the taper of the base 20*a*. This taper is again machined after assembly of the coupler 20*b* because of the difficulty in machining many individual pieces and attaining accuracy in the finished assembly.

Figure 4:
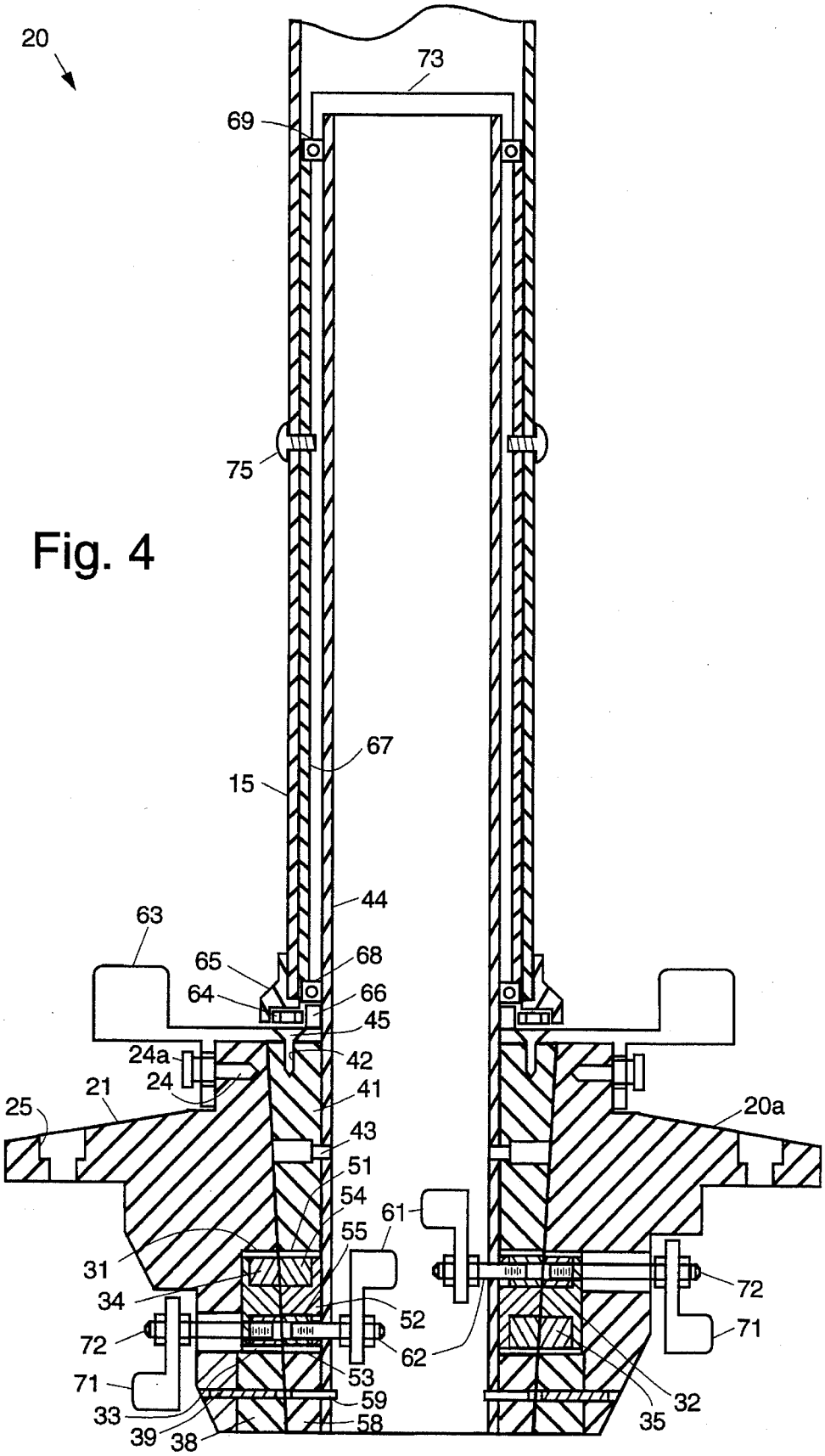
FIG. 4 illustrates a cross sectional view of the base and boom in a mated condition showing the electrical interface provided by the present invention.

FIG. 4 illustrates a cross sectional view of the base 20*a* and boom 15 in a mated condition showing the electrical interface provided by the quick release mechanical attachment 20 of the present invention. The coupler 20*b* attached to the inner mast tube 44 which is rotatably secured to the boom 15 by means of a plurality of bearings 68, 69. The boom 15 has an internal sleeve or tube 67 the mates with and holds the bearings 68, 69. The boom 15 is secured to the inner mast tube 44 by means of a plurality of screws 75. A nut 73 is disposed at the upper end of the inner mast tube that secures the bearings 68, 69 in place. The boom 15 is secured to the coupler 20*b* by means of a securing ring 65 that captivates a thrust bearing 64 and a teflon ring seal 66, that permit the boom or rotate during loading of the missile 13. A plurality of screws 45 are used to secure the breach lock plate 63 to the body 41. The breach lock plate 63 is used to secure the boom 15 to the base 20*a* using ramped slots that slide over the shoulder bolts 24*a* and pulls the body 41 so that its outer tapered surface mates with the inner tapered surface of the internal bore 22 of the base 20*a*.

In operation, the boom 15 is secured to the coupler 20*b* by means of the securing ring 65, tube 67, inner mast tube 44 and bearings 68, 69. The assembled boom 15 and coupler 20*b* are then slid into the internal bore 22 of the base 20*a*. The assembled boom 15 and coupler 20*b* are then rotated so that the breach lock plate 63 is captivated by the shoulder bolts 24*a*. The ramped slots in the breach lock plate 63 slide over the shoulder bolts 24a and pulls the body 41 so that its outer tapered surface mates with the inner tapered surface of the internal bore 22 of the base 20*a*.

The electrical components 30, 50 of the respective base 20*a* and coupler 20*b* of the quick release mechanical attachment 20 engage each other such that the copper conductors 34, 54, 35, 55 respectively mate with each other. Consequently, electrical power may be coupled to the hoist 17 by way of the mated copper conductors 34, 54, 35, 55. The bearings permit rotation of the boom 15 relative to the base 20*a*, which allows rotation of a missile 13 from the location of the storage compartment to the location of the launch rails 12. The circular copper conductors 34, 54, 35, 55 permit continuous electrical connection between a power source and the hoist 17.

Thus there has been described a new and improved quick release mechanical attachment having an integral electrical interconnect that is used to interface an electric crane mechanism to a vehicle, which electric crane mechanism is used to load a missile onto a missile launcher. It is to be understood that the above-described embodiment is merely illustrative of some of the many specific embodiments that represent applications of the principles of the present invention. Clearly, numerous and other arrangements can be readily devised by those skilled in the art without departing from the scope of the invention.

What is claimed is:

1. Missile loading apparatus for loading a missile onto a missile launcher disposed on a vehicle, said apparatus comprising:

a boom;

an electric hoist disposed on the boom for carrying the missile;

a quick release electro-mechanical attachment coupled between the boom and the vehicle that comprises:

a base comprising:

a body having an internal bore and a counterbore;

electrical contact means comprising a plurality of insulated and conductive members disposed in the counterbore;

a plurality of electrical connectors coupled to the conductive members; and securing ring means for securing the electrical contact means in the counterbore;

and wherein the base has a predetermined internal taper; and a coupler comprising:

a body;

an inner mast tube secured to the body;

electrical contact means comprising a plurality of insulated and conductive members secured to the body and the inner mast tube;

a plurality of electrical connectors coupled to the conductive members; and securing ring means coupled to the inner mast tube for securing the electrical contact means to the body;

and wherein the coupler has a predetermined external taper that substantially matches the taper of the base.

2. The apparatus of claim 1 wherein the bodies comprise aluminum.

3. The apparatus of claim 1 wherein the nonconductive spacers are comprised of teflon material.

4. The apparatus of claim 1 wherein the two conductive members are comprised of copper.

5. The apparatus of claim 1 wherein the first securing means comprises a first securing ring and a first plurality of pins.

6. The apparatus of claim 1 wherein the second securing means comprises a second securing ring and a second plurality of pins.

7. The apparatus of claim 1 wherein the electrical contact means comprises:

a first nonconductive spacer disposed in the counterbore;

a second nonconductive spacer having a T-shaped cross section disposed in the counterbore adjacent the first nonconductive spacer;

a third nonconductive spacer disposed in the counterbore adjacent the second nonconductive spacer, and wherein two openings are formed by the first, second and third nonconductive spacers that are surrounded by nonconductive material; and two conductive members disposed in the two openings formed by the nonconductive spacers.

8. The apparatus of claim 1 wherein the electrical contact comprises:

a fourth nonconductive spacer abuts the body;

a fifth nonconductive spacer disposed adjacent the fourth nonconductive spacer that has a T-shaped cross section;

a sixth nonconductive spacer disposed adjacent the fifth nonconductive spacer, and wherein two openings are formed by the fourth, fifth and sixth nonconductive spacers that are surrounded by nonconductive material; and two conductive members disposed in the openings formed by the nonconductive spacers.

9. In missile loading apparatus for loading a missile onto a missile launcher disposed on a vehicle, wherein the missile loading apparatus includes a boom and an electric hoist disposed on the boom for carrying the missile, a quick release electro-mechanical attachment for coupling the boom to the vehicle that comprises:

a base comprising:

a body having an internal bore and a counterbore;

electrical contact means comprising a plurality of insulated and conductive members disposed in the counterbore;

a plurality of electrical connectors coupled to the conductive members; and first securing means ring securing the electrical contact means in the counterbore and wherein the base has a predetermined internal taper; and a coupler comprising:

a body;

an inner mast tube secured to the body;

electrical contact means comprising a plurality of insulated and conductive members secured to the body and the inner mast tube;

a plurality of electrical connectors coupled to the conductive members; and second securing ring means coupled to the inner mast tube for securing the electrical contact means to the body:

and wherein the coupler has a predetermined external taper that substantially matches the taper of the base.

10. The apparatus of claim 9 wherein the bodies comprise aluminum.

11. The apparatus of claim 9 wherein the nonconductive spacers are comprised of teflon material.

12. The apparatus of claim 9 wherein the two conductive members are comprised of copper.

13. The apparatus of claim 9 wherein the first securing means comprises a first securing ring and a first plurality of pins.

14. The apparatus of claim 9 wherein the second securing means comprises a second securing ring and a second plurality of pins.

15. The apparatus of claim 9 wherein the electrical contact means comprises:

a first nonconductive spacer disposed in the counterbore;

a second nonconductive spacer having a T-shaped cross section disposed in the counterbore adjacent the first nonconductive spacer;

a third nonconductive spacer disposed in the counterbore adjacent the second nonconductive spacer, and wherein two openings are formed by the first, second and third nonconductive spacers that are surrounded by nonconductive material; and two conductive members disposed in the two openings formed by the nonconductive spacers.

16. The apparatus of claim 9 wherein the electrical contact means comprises:

a fourth nonconductive spacer that abuts the body;

a fifth nonconductive spacer disposed adjacent the fourth nonconductive spacer that has a T-shaped cross section;

a sixth nonconductive spacer disposed adjacent the fifth nonconductive spacer, and wherein two openings are formed by the fourth, fifth and sixth nonconductive spacers that are surrounded by nonconductive material; and two conductive members disposed in the openings formed by the nonconductive spacers.

17. In missile loading apparatus for loading a missile onto a missile launcher disposed on a vehicle, wherein the missile loading apparatus includes a boom and an electric hoist disposed on the boom for carrying the missile, a quick release electro-mechanical attachment for coupling the boom to the vehicle that comprises:

a base comprising:

a body having an internal bore and a counterbore;

a first nonconductive spacer disposed in the counterbore;

a second nonconductive spacer having a T-shaped cross section disposed in the counterbore adjacent the first nonconductive spacer;

a third nonconductive spacer disposed in the counterbore adjacent the second nonconductive spacer, and wherein two openings are formed by the first, second and third nonconductive spacers that are surrounded by nonconductive material;

two conductive members disposed in the two openings formed by the nonconductive spacers;

a plurality of electrical connectors coupled to the conductive members; and first securing means for securing ring the nonconductive spacers and the conductive members in the counterbore;

and wherein the base has it predetermined internal taper; and a coupler comprising:

a body;

an inner mast tube secured to the body;

a fourth nonconductive spacer that abuts the body;

a fifth nonconductive spacer disposed adjacent the fourth nonconductive spacer that has a T-shaped cross section:

a sixth nonconductive spacer disposed adjacent the fifth nonconductive spacer, and wherein two openings are formed by the fourth, fifth and sixth nonconductive spacers that are surrounded by nonconductive material;

two conductive members disposed in the openings formed by the nonconductive spacers:

a plurality of electrical connectors coupled to the conductive members; and second securing means coupled to the inner mast tube for securing ring the nonconductive spacers and the conductive members to the body;

and wherein the coupler has a predetermined external taper that substantially matches the taper of the base.

* * * * *